US010125991B2

(12) United States Patent
Ramier et al.

(10) Patent No.: US 10,125,991 B2
(45) Date of Patent: Nov. 13, 2018

(54) MULTI-FUNCTIONAL FUEL NOZZLE WITH A HEAT SHIELD

(71) Applicant: SIEMENS AKTIENGESELLSCHAFT, München (DE)

(72) Inventors: Stephen A. Ramier, Fredericton (CA); Vinayak V. Barve, Oviedo, FL (US); Richard L. Thackway, Oviedo, FL (US); Charalambos Polyzopoulos, Orlando, FL (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 95 days.

(21) Appl. No.: 15/328,525

(22) PCT Filed: Aug. 14, 2014

(86) PCT No.: PCT/US2014/051056
§ 371 (c)(1),
(2) Date: Jan. 24, 2017

(87) PCT Pub. No.: WO2016/024975
PCT Pub. Date: Feb. 18, 2016

(65) Prior Publication Data
US 2017/0211810 A1 Jul. 27, 2017

(51) Int. Cl.
*F23R 3/28* (2006.01)
*F23R 3/36* (2006.01)
(Continued)

(52) U.S. Cl.
CPC ..... *F23R 3/283* (2013.01); *F23D 11/38* (2013.01); *F23D 14/76* (2013.01); *F23D 14/78* (2013.01);
(Continued)

(58) Field of Classification Search
CPC .. F23R 3/28; F23R 3/283; F23R 3/286; F23R 3/36; F23D 11/38; F23D 14/76; F23D 14/78; F23D 2214/00; F23D 2900/00018
See application file for complete search history.

(56) References Cited

U.S. PATENT DOCUMENTS 2,884,758 A 5/1959 Oberle
3,013,732 A 12/1961 Webster et al.
(Continued)

FOREIGN PATENT DOCUMENTS

EP 1132593 A2 9/2001
EP 2196733 A1 6/2010
(Continued)

OTHER PUBLICATIONS

PCT International Search Report and Written Opinion dated Apr. 24, 2015 corresponding to PCT Application No. PCT/US2014/051056 filed Aug. 14, 2014.

*Primary Examiner* — William H Rodriguez

(57) ABSTRACT

A multi-functional fuel nozzle (10) for a combustion turbine engine is provided. A nozzle cap (50) may be disposed at a downstream end of the nozzle. A heat shield (60) is mounted onto the nozzle cap. A plurality of cooling channels (62) is arranged between a forward face of the nozzle cap and a corresponding back side of the heat shield. The plurality of cooling channels may be arranged to discharge cooling air over a forward face of an atomizer assembly in the multi-functional fuel nozzle.

18 Claims, 7 Drawing Sheets

(51) Int. Cl.
*F23D 14/76* (2006.01)
*F23D 11/38* (2006.01)
*F23D 14/78* (2006.01)

(52) U.S. Cl.
CPC ..... *F23R 3/36* (2013.01); *F23D 2214/00* (2013.01); *F23D 2900/00018* (2013.01)

(56) References Cited

U.S. PATENT DOCUMENTS 3,777,983 A 12/1973 Hibbins
4,139,157 A * 2/1979 Simmons ..... F23D 11/107 239/400
4,311,277 A 1/1982 Stratton
5,361,578 A 11/1994 Donlan
5,423,173 A 6/1995 Lemon et al.
5,477,685 A * 12/1995 Samuelson ..... F23D 14/02 239/406
5,826,798 A * 10/1998 Schindler ..... F23D 11/383 239/403
5,873,237 A 2/1999 Medla et al.
6,021,635 A 2/2000 Gaag et al.
6,024,301 A * 2/2000 Hurley ..... B05B 1/3436 239/463
6,068,470 A 5/2000 Zarzalis et al.
6,402,059 B1 6/2002 Benz et al.
6,547,163 B1 4/2003 Mansour et al.
6,622,944 B1 * 9/2003 Hurley ..... F23D 11/102 239/426
6,814,307 B2 * 11/2004 Hurley ..... B05B 1/3484 239/463
7,200,997 B2 4/2007 Carlson, Jr. et al.
7,509,809 B2 3/2009 Patel et al.
7,963,764 B2 6/2011 Brautsch et al.
8,146,365 B2 * 4/2012 Shum ..... F23D 11/108 60/740
8,220,269 B2 7/2012 Poyyapakkam
8,726,668 B2 5/2014 Patel et al.
9,958,152 B2 * 5/2018 Ramier ..... F23C 1/08
2005/0039456 A1 * 2/2005 Hayashi ..... F23D 11/107 60/737
2005/0241319 A1 11/2005 Graves et al.
2006/0027232 A1 * 2/2006 Parker ..... F23D 14/48 126/349
2007/0006587 A1 * 1/2007 Ohta ..... F23R 3/286 60/746
2007/0033919 A1 * 2/2007 Tanimura ..... F23D 17/002 60/39.463
2009/0044538 A1 * 2/2009 Pelletier ..... F23R 3/14 60/740
2009/0197214 A1 8/2009 Bretz
2010/0095677 A1 4/2010 Dawson et al.
2010/0205971 A1 * 8/2010 Williams ..... F23D 11/107 60/748
2010/0263382 A1 10/2010 Mancini et al.
2011/0314831 A1 12/2011 Abou-Jaoude et al.
2013/0031907 A1 2/2013 Woerz et al.
2013/0036740 A1 2/2013 Woerz et al.
2014/0291418 A1 * 10/2014 Ruffing ..... F23R 3/14 239/403
2016/0348911 A1 * 12/2016 Polyzopoulos ..... F01D 9/023

FOREIGN PATENT DOCUMENTS

GB 2038473 A 12/1978
JP 5074830 B2 6/1975
JP 2003247425 A 9/2003

* cited by examiner

MULTI-FUNCTIONAL FUEL NOZZLE WITH A HEAT SHIELD

BACKGROUND

1. Field

Disclosed embodiments relate to a fuel nozzle for a combustion turbine engine, such as a gas turbine engine. More particularly, disclosed embodiments relate to an improved multi-functional fuel nozzle with a heat shield.

2. Description of the Related Art

Gas turbine engines include one or more combustors configured to produce a hot working gas by burning a fuel in compressed air. A fuel injecting assembly or nozzle is employed to introduce fuel into each combustor. To provide flexibility to the user, such fuel nozzles may be of a multi-fuel type that are capable of burning either a liquid or a gaseous fuel, or both simultaneously.

Combustion in gas turbine combustors results in the formation of oxides of nitrogen (NOx) in the combusted gas, which is considered undesirable. One technique for reducing the formation of NOx involves injecting water, via the fuel injecting nozzle, into the combustor along with the fuel. U.S. patent application Ser. No. 13/163,826 discloses a fuel nozzle assembly capable of burning either gaseous or liquid fuel, or both, along with liquid water injection.

DETAILED DESCRIPTION

The inventors of the present invention have recognized some issues that can arise in the context of certain prior art multi-fuel nozzles. For example, components utilized in these multi-fuel nozzles tend to overheat causing cracking and erosion in such components. This leads to costly repairs and time consuming servicing operations in order to replace defective components in the nozzle.

At least in view of such recognition, the present inventors propose an innovative multi-functional fuel nozzle that cost-effectively and reliably provides back side cooling to a heat shield disposed at a downstream end of the nozzle. The proposed heat shield includes cooling channels configured to target relatively hotter regions in a nozzle cap. Further aspects of the proposed multi-functional fuel nozzle will be discussed in the disclosure below.

Figure 1:
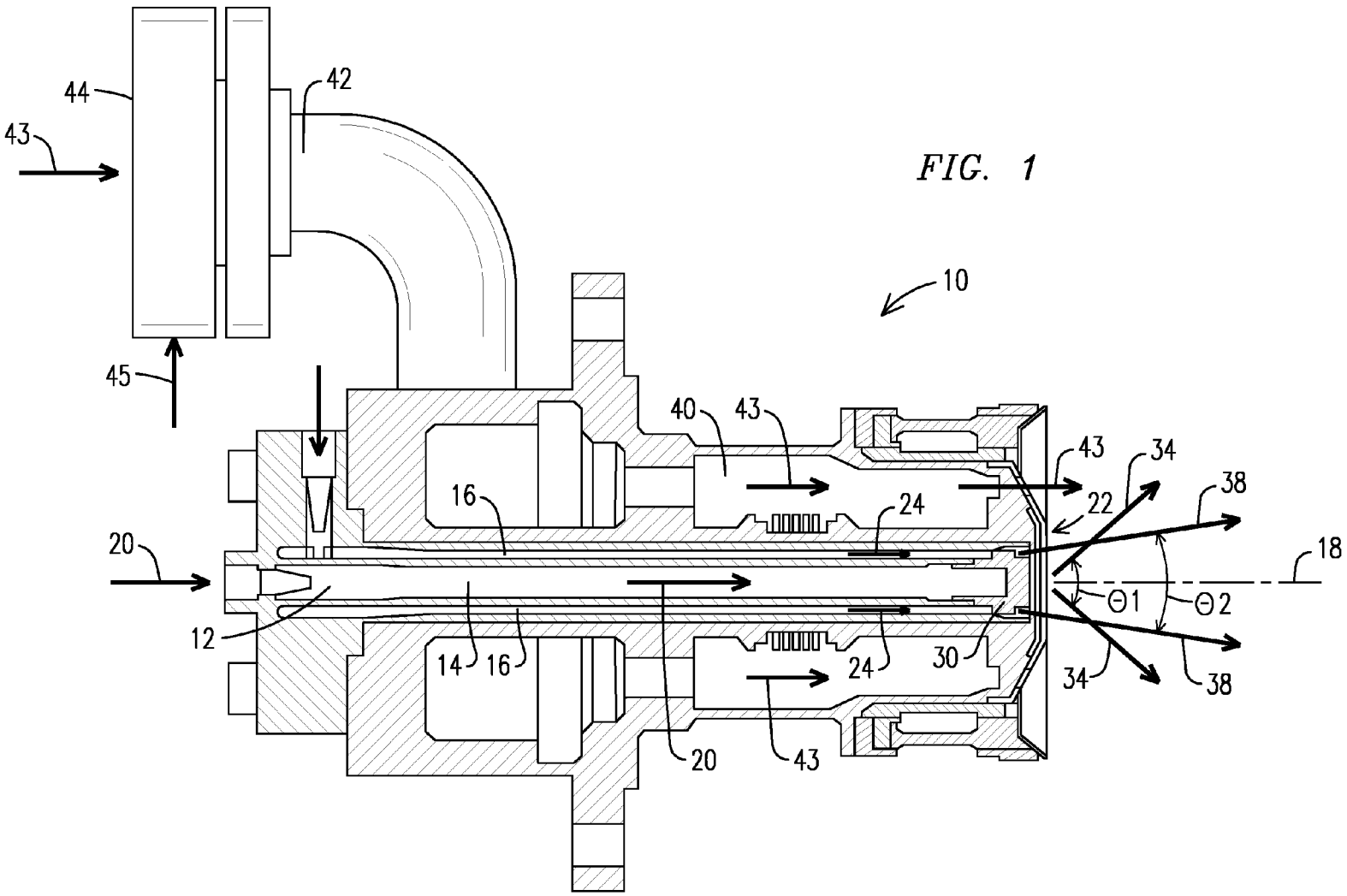
FIG. 1 is a cutaway, side view of one non-limiting embodiment of a multi-fuel nozzle embodying aspects of the present invention.

FIG. 1 is a cutaway, side view of one non-limiting embodiment of a multi-functional fuel nozzle 10 embodying aspects of the present invention. In this embodiment, multi-functional fuel nozzle 10 includes an annular fuel-injecting lance 12 including a first fluid circuit 14 and a second fluid circuit 16. First fluid circuit 14 is centrally disposed within fuel-injecting lance 12. First fluid circuit 14 extends along a longitudinal axis 18 of lance 12 to convey a first fluid (schematically represented by arrows 20) to a downstream end 22 of lance 12.

Figure 3:
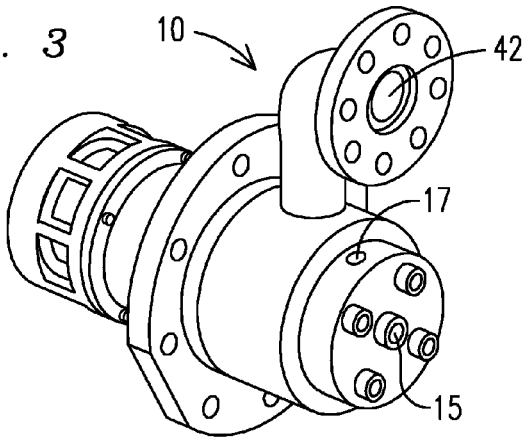
FIG. 3 is a rearwardly, isometric view of the multi-functional fuel nozzle shown in FIG. 1.
Figure 4:
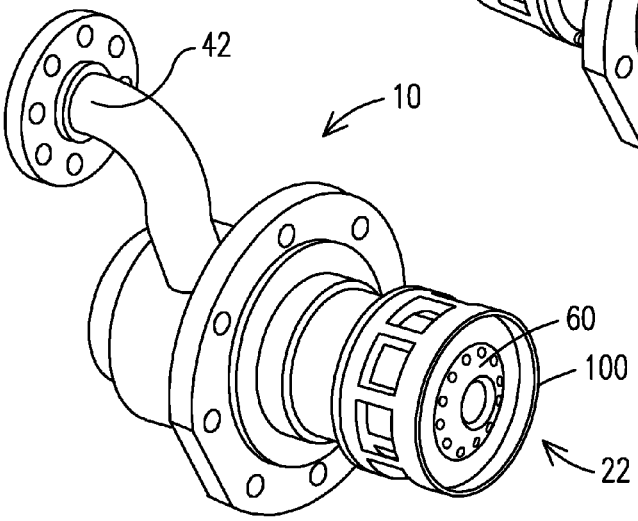
FIG. 4 is a forwardly, isometric view of the multi-functional fuel nozzle shown in FIG. 1.

Second fluid circuit 16 is annularly disposed about first fluid circuit 14 to convey a second fluid (schematically represented by arrows 24) to downstream end 22 of lance 12. As may be appreciated in FIG. 3, a centrally disposed first inlet 15 may be used to introduce first fluid 20 into first fluid circuit 14. Similarly, a second inlet 17 may be used to introduce second fluid 24 into second fluid circuit 16.

As will be discussed in greater detail below, in one non-limiting embodiment one of the first or second fluids 20, 24 may comprise a liquid fuel, such as an oil distillate, conveyed by one of the first and second fluid circuits 14, 16 during a liquid fuel operating mode of the combustion turbine engine. The other of the first and second fluids 20, 24, conveyed by the other of first and second fluid circuits 14, 16, may comprise a selectable non-fuel fluid, such as air or water.

Figure 2:
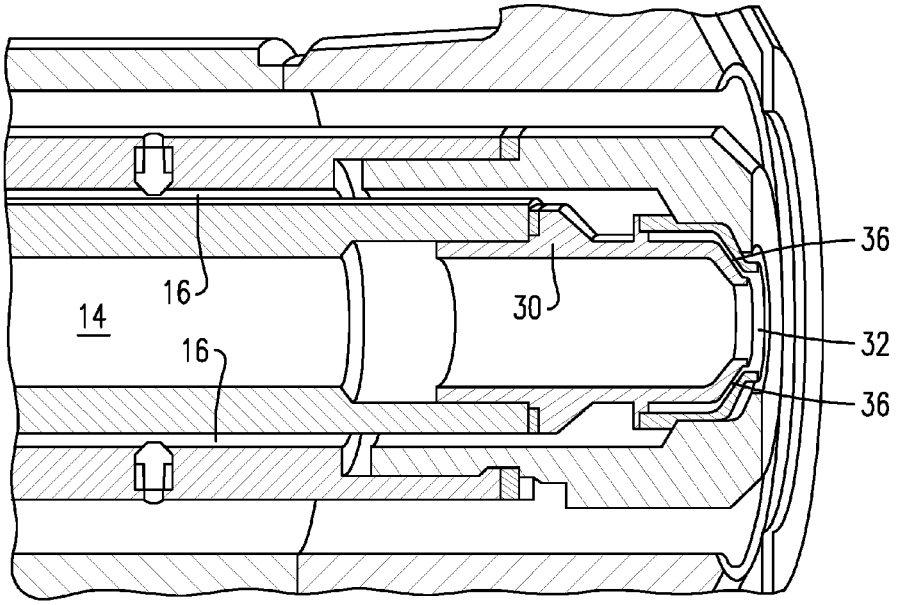
FIG. 2 is an isometric, fragmentary cutaway view illustrating details of one non-limiting example of an atomizer disposed at a downstream end of a multi-fuel nozzle embodying aspects of the present invention.

An atomizer 30 is disposed at downstream end 22 of lance 12. As may be appreciated in FIG. 2, in one non-limiting embodiment, atomizer 30 includes a first ejection orifice 32 responsive to first fluid circuit 14 to form a first atomized ejection cone (schematically represented by lines 34 (FIG. 1). Atomizer 30 further includes a second ejection orifice 36 responsive to second fluid circuit 16 to form a second atomized ejection cone (schematically represented by lines 38 (FIG. 2)). Thus, it will be appreciated that in this embodiment, atomizer 30 comprises a dual orifice atomizer.

In one non-limiting embodiment, orifices 32, 36 of atomizer 30 are respectively configured so that the first and second ejection cones 34, 38 formed with atomizer 30 comprise concentric patterns, such as cones that intersect with one another over a predefined angular range. Without limitation, such patterns may comprise solid cones, semi-solid cones, hollow cones, fine spray cones, sheets of air, or individual droplets (spray).

In one non-limiting embodiment, an angular range (θ1, (FIG. 1)) of first atomized ejection cone 34 extends from approximately 80 degrees to approximately 120 degrees. In a further non-limiting embodiment, the angular range θ1 of first atomized ejection cone 34 extends from approximately 90 degrees to approximately 115 degrees. In still a further non-limiting embodiment, the angular range θ1 of first atomized ejection cone 34 extends from approximately 104 degrees to approximately 110 degrees.

In one non-limiting embodiment, an angular range (θ2) of second atomized ejection cone 38 extends from approximately 40 degrees to approximately 90 degrees. In a further non-limiting embodiment, the angular range θ2 of second atomized ejection cone 38 extends from approximately 60 degrees to approximately 80 degrees.

It is believed that relatively larger angular differences between first and second atomized ejection cones 34, 38 tend to provide enhanced atomization during an ignition event of the liquid fuel. Conversely, relatively smaller angular differences between first and second atomized ejection cones 34, 38 tend to provide enhanced NOx reduction capability during gas fuel operation. For example, in a non-limiting combination where the angular range θ1 of first atomized ejection cone 34 is approximately 110 degrees and the angular range θ2 of second atomized ejection cone 38 is approximately 40 degrees would likely provide enhanced atomization during the ignition event of the liquid fuel compared to, for example, another non-limiting combination where the angular range θ1 of first atomized ejection cone 34 is approximately 110 degrees and the angular range θ2 of second atomized ejection cone 38 is approximately 80 degrees. As noted above, the latter example combination would likely provide enhanced NOx reduction capability during gas fuel operation. Broadly, the predefined angular range of intersection of the first and second atomized cones may be tailored to optimize a desired operational characteristic of the engine, such as atomization performance during an ignition event of the liquid fuel, Nox abatement performance, etc.

In accordance with aspects of disclosed embodiments, the operational functionality respectively provided by first and second fluid circuits 14, 16 and the first and second ejection cones 34, 38 formed by atomizer 30 may be optionally interchanged based on the needs of a given application. That is, the type of fluids respectively conveyed by first and second fluid circuits 14, 16 may be optionally interchanged based on the needs of a given application.

For example, in one non-limiting embodiment, during an ignition event of the liquid fuel, the selectable non-fuel fluid may comprise air, which in one example case is conveyed by first fluid circuit 14, and, in this case, the first atomized ejection cone 38 comprises a cone of air, and the liquid fuel comprises an oil fuel, which is conveyed by second fluid circuit 16, and, in this case, the second atomized ejection cone 34 comprises a cone of atomized oil fuel. In this embodiment, subsequent to the ignition event of the liquid fuel, the selectable non-fuel fluid comprises water (in lieu of air), which is conveyed by first fluid circuit 14, and the first atomized ejection cone 34 comprises a cone of atomized water.

In one alternative non-limiting embodiment, during the ignition event of the liquid fuel—which in this alternative embodiment is conveyed by first circuit 14 in lieu of second circuit 16—and, thus in this case, the first atomized ejection cone 34 comprises a cone of atomized oil fuel, and the selectable non-fuel fluid comprises air, which in this case is conveyed by second circuit 16 in lieu of first circuit 14, and, thus the second atomized ejection cone 38 comprises a cone of air. Subsequent to the ignition event of the liquid fuel, the selectable non-fuel fluid comprises water (in lieu of air), which in this alternative embodiment is conveyed by second fluid circuit 16, and thus second atomized ejection cone 38 comprises a cone formed of atomized water.

In one non-limiting embodiment, a plurality of gas fuel channels 40 is circumferentially disposed about the longitudinal axis 18 of fuel lance 12. Gas fuel channels 40 are positioned circumferentially outwardly relative to fuel lance 12. A gas inlet 42 may be used to introduce gas fuel (schematically represented by arrows 43) into gas fuel channels 40. In one non-limiting embodiment, during a gas fuel operating mode of the engine, the selectable non-fuel fluid comprises water, which is conveyed by at least one of the first and second fluid circuits 14, 16, and thus at least one of the first and second ejection cones 38, 34 comprises a respective cone formed of atomized water. Optionally, during the gas fuel operating mode of the engine, the plurality of gas fuel channels 40 may be configured to convey water mixed with fuel gas alone or in combination with at least one of the first and second fluid circuits 14, 16. In one non-limiting embodiment, water (schematically represented by arrow 45) may be introduced into the plurality of gas fuel channels 40 by way of a doughnut-shaped inlet 44 (FIG. 1).

Figure 5:
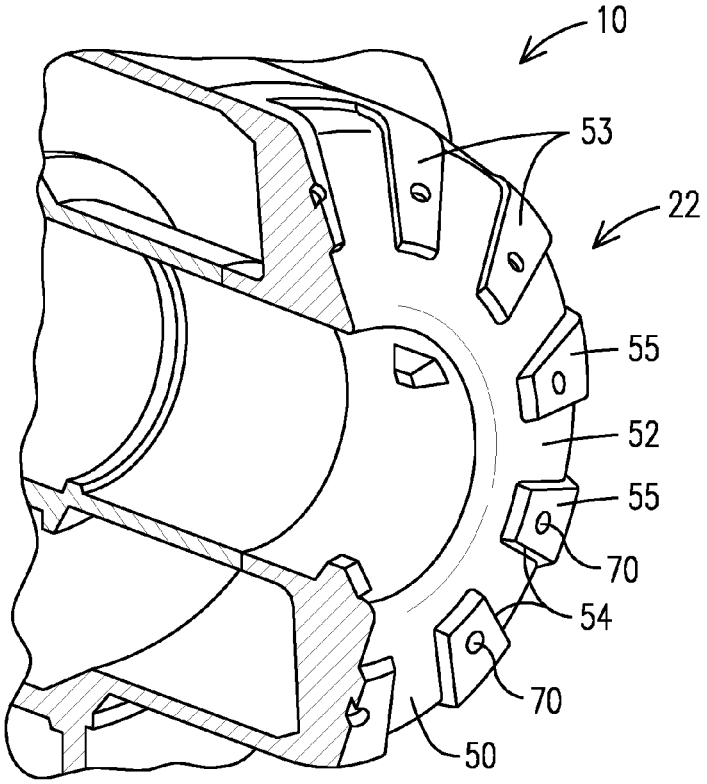
FIG. 5 is an isometric, fragmentary cutaway view illustrating details of one non-limiting example of a nozzle cap disposed at the downstream end of a multi-functional fuel nozzle embodying aspects of the present invention.
Figure 6:
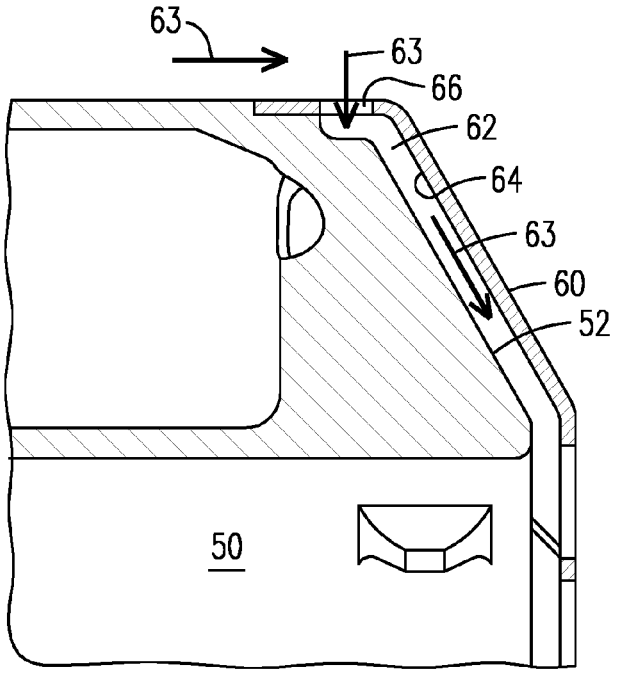
FIG. 6 is a fragmentary side view of the nozzle cap shown in FIG. 5 and a heat shield mounted on a forward face of the nozzle cap.
Figure 7:
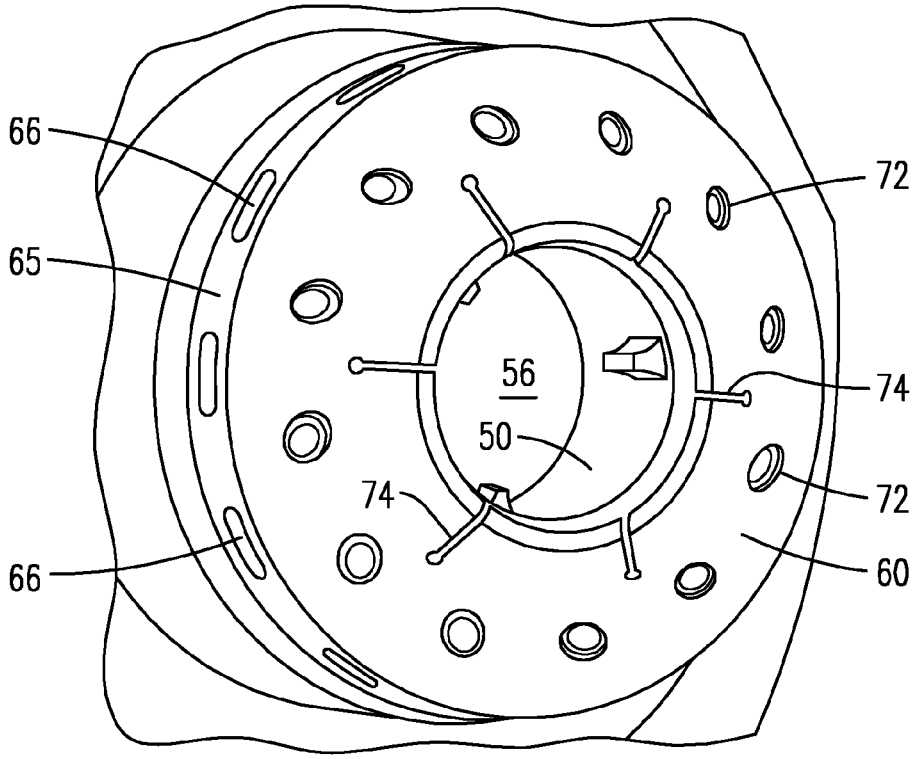
FIG. 7 is a forwardly isometric view illustrating the heat shield and further illustrating a centrally-disposed bore in the nozzle cap.

FIG. 5 is an isometric, fragmentary cutaway view illustrating details of one non-limiting embodiment of a nozzle cap 50 disposed at downstream end 22 of multi-functional fuel nozzle 10. As may be appreciated in FIGS. 6 and 7, a heat shield 60 is mounted onto nozzle cap 50. A plurality of cooling channels 62 (for simplicity of illustration just one cooling channel is shown in FIG. 6 for conveying a cooling medium, such as air (schematically represented by arrows 63 (FIG. 6)), is arranged between a forward face 52 of nozzle cap and a corresponding back side 64 of the heat shield.

In one non-limiting embodiment, nozzle cap 50 includes a plurality of castellations 53 (FIG. 5) circumferentially arranged on forward face 52 of nozzle cap 50. Mutually facing lateral surfaces 54 of adjacent castellations define respective recesses on forward face 52 of nozzle cap 50. First portions of back side 64 of heat shield 60 abut against respective top surfaces 55 of castellations 53 on forward face 52 of nozzle cap 50. Second portions of back side 64 of heat shield 60 (the portions that do not abut against the respective top surfaces 55 of castellations 53 are arranged to close corresponding top areas of the recesses on forward face 52 of nozzle cap 50 to form the plurality of cooling channels 62.

Figure 9:
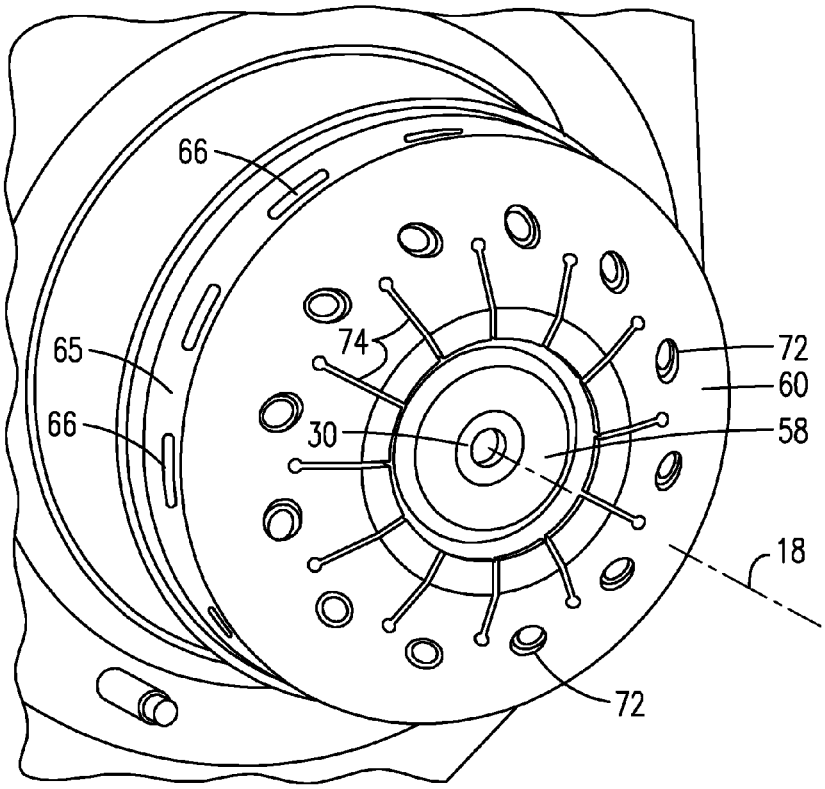
FIG. 9 is forwardly isometric view illustrating the heat shield and further illustrating one non-limiting example of an atomizer assembly installed in the bore of the nozzle cap.

In one non-limiting embodiment, heat shield 60 comprises an annular lip 65 (FIGS. 7, 9) including a plurality of slots 66 circumferentially disposed about longitudinal axis 18 of nozzle 10. Slots 66 are positioned to feed cooling air to cooling channels 62. Nozzle cap 50 comprises a centrally located bore 56 (FIG. 7) arranged to accommodate a downstream portion of fuel lance 12 of nozzle 10. Downstream portion of fuel lance 12 includes an atomizer assembly 58 (FIG. 9), such as may include atomizer 30.

In one non-limiting embodiment, cooling channels 62 are arranged to convey the cooling medium in a direction towards the centrally located bore 56 to discharge the cooling medium over a forward face of atomizer assembly 58.

Figure 8:
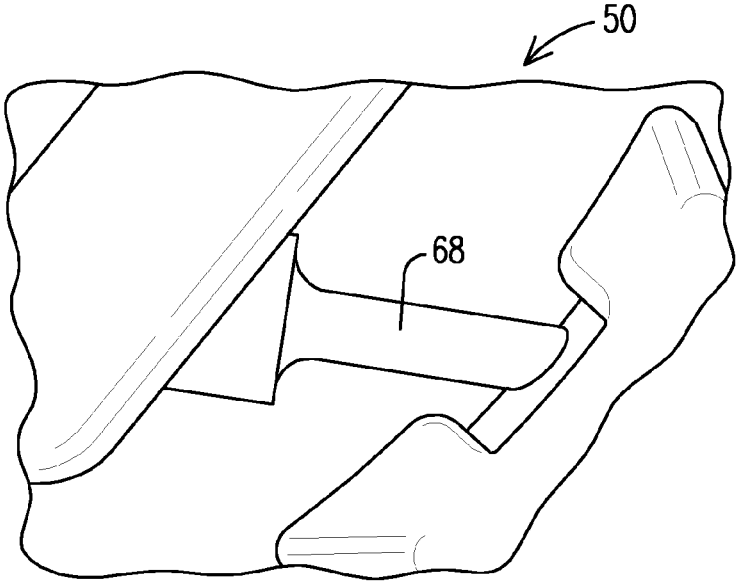
FIG. 8 is schematic representation of a gas fuel channel in the nozzle cap.

Nozzle cap 50 further comprises a plurality of gas fuel channels 68 (FIG. 8) circumferentially disposed about longitudinal axis 18 of nozzle 10. Gas fuel channels 68 comprise outlets 70 (FIG. 5) arranged at respective top surfaces 55 of castellations 53. Heat shield 60 similarly comprises a plurality of openings 72 in correspondence with the outlets 70 arranged at the respective top surfaces of the castellations.

In one non-limiting embodiment, heat shield 60 comprises a plurality of slits 74 radially extending a predefined distance from an inner diameter of heat shield 60. Slits 74 may be interposed between at least some adjacent pairs of the plurality of openings 72 in heat shield 60. As will be appreciated by those skilled in the art, slits 74 provide stress relief functionality to heat shield 60.

Figure 10:
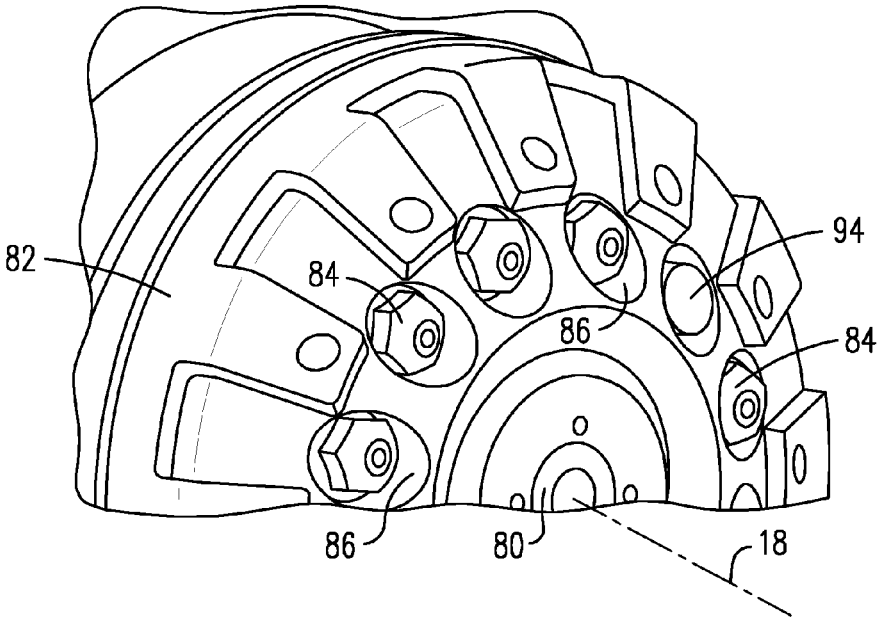
FIG. 10 is a forwardly, fragmentary isometric view illustrating details of another non-limiting example of a nozzle cap including an annular array of atomizers disposed at the downstream end of a multi-functional fuel nozzle embodying further aspects of the present invention.
Figure 11:
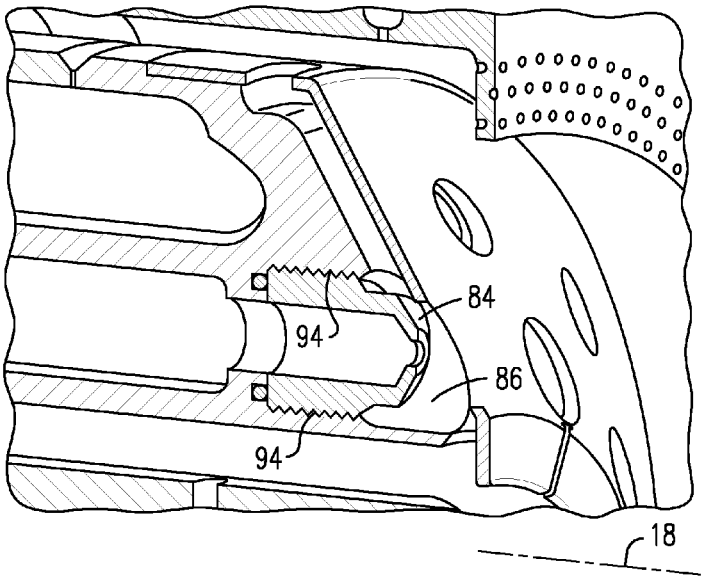
FIG. 11 is a cutaway, fragmentary isometric view illustrating details of one atomizer in the array of atomizers.
Figure 12:
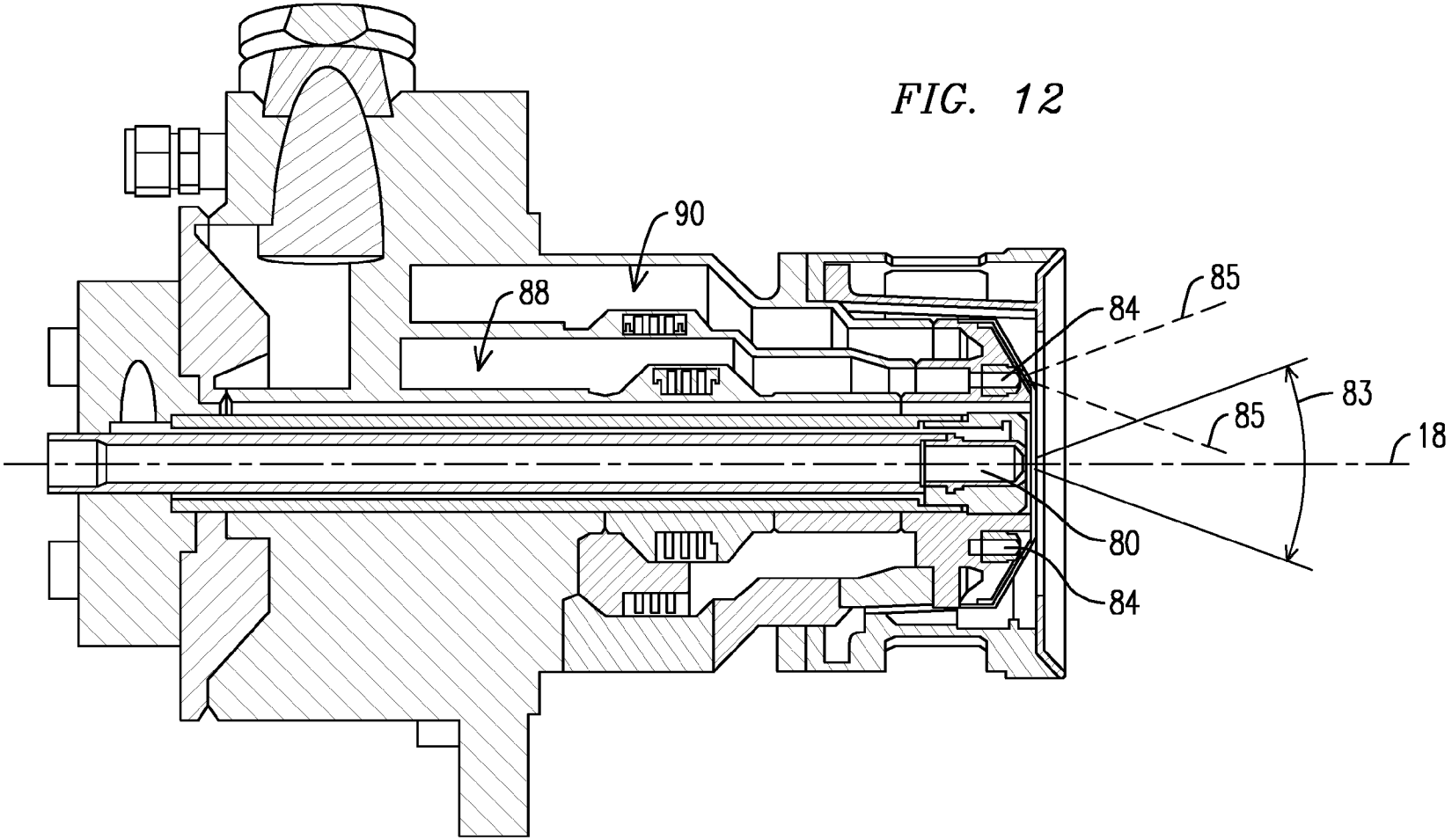
FIG. 12 is a cutaway, side view of one non-limiting embodiment of a multi-functional fuel nozzle embodying the annular array of atomizers.

As illustrated in FIGS. 10-12, in one non-limiting embodiment, a centrally-located atomizer 80 (e.g., a single orifice atomizer) may be disposed in the centrally located bore of a nozzle cap 82 to form a first atomized ejection cone, schematically represented by lines 83 (FIG. 12). In this embodiment, an array of atomizers 84 may be installed in nozzle cap 82 to form an array of respective second atomized ejection cones (one cone in the array is schematically represented by lines 85 (FIG. 12)). Atomizer array 84 may be circumferentially disposed about longitudinal axis 18 of the lance. Atomizer array 84 may be positioned radially outwardly relative to centrally-located atomizer 80 to form an array of respective second atomized ejection cones. In one non-limiting embodiment, atomizer array 84 comprises an annular array and nozzle cap 82 comprises an annular array of atomizer outlets 86 disposed on a forward face of nozzle cap 82.

In one non-limiting embodiment, during a liquid fuel operating mode of the engine, centrally-located atomizer 80 is coupled to a first fluid circuit 86 (FIG. 12) conveying a liquid fuel to form an atomized cone of liquid fuel and the array of circumferentially disposed atomizers 84 is coupled to a second fluid circuit 88 conveying water to form an atomized array of water cones.

In one alternative embodiment, during a liquid fuel operating mode of the engine, centrally-located atomizer 80 is coupled to first fluid circuit 86, which in this alternative embodiment conveys water to form an atomized cone of water and the array of circumferentially disposed atomizers 84 is coupled to second fluid circuit 88, which in this alternative embodiment conveys liquid fuel to form an atomized array of liquid fuel cones.

Nozzle cap 82 further comprises a plurality of gas fuel channels 90 circumferentially disposed about longitudinal axis 18. The plurality of gas fuel channels 90 being positioned radially outwardly relative to array of atomizers 84.

In one non-limiting embodiment, during a gas fuel operating mode of the engine, the array of atomizers 84 is coupled to first fluid circuit 86 conveying water to form an atomized array of water cones. In one alternative embodiment, during a gas fuel operating mode of the engine, centrally-located atomizer 80 is coupled to second fluid circuit 88, which in this alternative embodiment conveys water to form an atomized cone of water.

Figure 13:
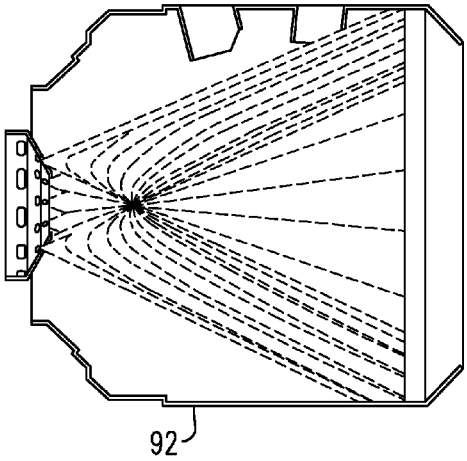
FIGS. 13 and 14 illustrate respective non-limiting embodiments comprising a different number of atomizers in the array and a different angular spread in the ejections cones formed with such atomizer arrays.
Figure 14:
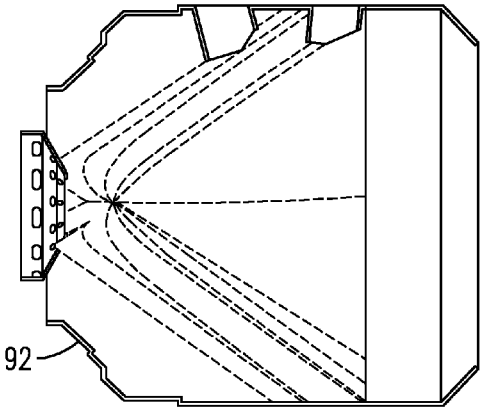

As may be conceptually appreciated in FIGS. 13 and 14, the numbers of atomizers in the array and/or an angular spread of the respective second atomized ejection cones may be arranged to target a desired zone in a combustor basket 92. FIG. 13 illustrates a non-limiting embodiment where the number of atomizers in the array is 12 and the angular spread of each cone is approximately 50 degrees. FIG. 14 illustrates a non-limiting embodiment where the number of atomizers in the array is 6 and the angular spread of each cone is approximately 70 degrees.

In one non-limiting embodiment, the array of atomizers 84 may be affixed to nozzle cap 82 by way of respective threaded connections 94 (FIG. 11). This facilitates removal and replacement of respective atomizers in the array of atomizers. In one optional embodiment, the number of atomizers in the array 84 may involve removing at least some of the atomizers and plugging with respective suitable plugs 94 (FIG. 10 shows one example plugged outlet) the outlets previously occupied by the removed atomizers.

In operation, aspects of the disclosed multi-functional fuel nozzle effectively allow meeting NOx target levels within an appropriate margin, and further allow practically eliminating water impingement on the liner walls of a combustor basket and this is conducive to improving liner durability and appropriately meeting predefined service intervals in connection with these components of the turbine engine.

While embodiments of the present disclosure have been disclosed in exemplary forms, it will be apparent to those skilled in the art that many modifications, additions, and deletions can be made therein without departing from the spirit and scope of the invention and its equivalents, as set forth in the following claims.

What is claimed is:

1. A multi-functional fuel nozzle for a combustion turbine engine, comprising:

a nozzle cap disposed at a downstream end of the nozzle;

a heat shield mounted onto the nozzle cap; and a plurality of cooling channels arranged between a forward face of the nozzle cap and a corresponding back side of the heat shield, wherein the heat shield comprises an annular lip comprising a plurality of slots circumferentially disposed about a longitudinal axis of the nozzle, the slots positioned to feed cooling air to the cooling channels.

2. The multi-functional fuel nozzle of claim 1, wherein the nozzle cap comprises a plurality of castellations circumferentially arranged on the forward face of the nozzle cap.

3. The multi-functional fuel nozzle of claim 2, wherein mutually facing lateral surfaces of adjacent castellations define respective recesses on the forward face of the nozzle cap.

4. The multi-functional fuel nozzle of claim 3, wherein first portions of the back side of the heat shield abut against respective top surfaces of the castellations on the forward face of the nozzle cap.

5. The multi-functional fuel nozzle of claim 4, wherein second portions of the back side of the heat shield that do not abut against the respective top surfaces of the castellations are arranged to close corresponding top areas of the recesses on the forward face of the nozzle cap to form the plurality of cooling channels.

6. The multi-functional fuel nozzle of claim 1, wherein the nozzle cap comprises a centrally located bore arranged to accommodate a downstream portion of a liquid fuel lance of the nozzle.

7. The multi-functional fuel nozzle of claim 6, wherein the downstream portion of the liquid fuel lance comprises an atomizer assembly.

8. The multi-functional fuel nozzle of claim 7, wherein the plurality of cooling channels are arranged to convey cooling air towards the centrally located bore to discharge cooling air over a forward face of the atomizer assembly.

9. The multi-functional fuel nozzle of claim 8, wherein the nozzle cap further comprises a plurality of gas fuel channels circumferentially disposed about a longitudinal axis of the nozzle, the gas fuel channels comprising outlets arranged at respective top surfaces of the castellations.

10. The multi-functional fuel nozzle of claim 9, wherein the heat shield comprises a plurality of openings in correspondence with the outlets arranged at the respective top surfaces of the castellations.

11. The multi-functional fuel nozzle of claim 10, wherein the heat shield comprises a plurality of slits radially extending a predefined distance from an inner diameter of the heat shield, the slits interposed between at least some adjacent pairs of the plurality of openings in the heat shield.

12. A multi-functional fuel nozzle for a combustion turbine engine, comprising:

a nozzle cap disposed at a downstream end of the nozzle;

a heat shield mounted onto the nozzle cap; and a plurality of castellations circumferentially arranged on a forward surface of the nozzle cap, wherein mutually facing lateral surfaces of adjacent castellations define respective recesses on the forward surface of the nozzle cap, respective top areas of the recesses being closed by corresponding portions of a back side of the heat shield to define a plurality of cooling channels arranged to provide cooling to a forward face of the nozzle cap, wherein the heat shield comprises an annular lip comprising a plurality of slots circumferentially disposed about a longitudinal axis of the nozzle, the slots positioned to feed cooling air to the cooling channels.

13. The multi-functional fuel nozzle of claim 12, wherein portions of the back side of the heat shield abut against respective top surfaces of the castellations on the forward face of the nozzle cap.

14. The multi-functional fuel nozzle of claim 12, wherein the nozzle cap comprises a centrally located bore arranged to accommodate a downstream portion of a liquid fuel lance of the nozzle.

15. The multi-functional fuel nozzle of claim 14, wherein the downstream portion of the liquid fuel lance comprises an atomizer assembly.

16. The multi-functional fuel nozzle of claim 15, wherein the plurality of cooling channels are arranged to convey cooling air towards the centrally located bore to discharge cooling air over a forward face of the atomizer assembly.

17. The multi-functional fuel nozzle of claim 16, wherein the nozzle cap further comprises a plurality of gas fuel channels circumferentially disposed about a longitudinal axis of the nozzle, the gas fuel channels comprising outlets arranged at respective top surfaces of the castellations.

18. The multi-functional fuel nozzle of claim 17, wherein the heat shield comprises a plurality of openings in correspondence with the outlets arranged at the respective top surfaces of the castellations.

* * * * *